United States Patent [19]

Shaps

[11] 4,061,333

[45] Dec. 6, 1977

[54] ADJUSTABLE TENNIS RACQUET

[76] Inventor: Spencer N. Shaps, 42 Winding Way, Parsippany NJ 07054

[21] Appl. No.: 705,667

[22] Filed: July 15, 1976

[51] Int. Cl.[2] ..... A63B 51/12

[52] U.S. Cl. ..... 273/73 E

[58] Field of Search ..... 273/73 E, 73 G

[56] References Cited

U.S. PATENT DOCUMENTS

| | | | |
|---|---|---|---|
| 880,306 | 2/1908 | Imlach | 273/73 E |
| 1,535,125 | 4/1925 | McDougall | 273/73 E |
| 1,559,986 | 11/1925 | Quick | 273/73 E |
| 1,663,039 | 3/1928 | Craven | 273/73 E |
| 3,904,202 | 9/1975 | De Lorean | 273/73 E |
| 4,026,553 | 5/1977 | Vendramini | 273/73 E |

FOREIGN PATENT DOCUMENTS

| | | | |
|---|---|---|---|
| 5,034 of | 1883 | United Kingdom | 273/73 E |
| 1,219 of | 1883 | United Kingdom | 273/73 E |
| 5,025 of | 1915 | United Kingdom | 273/73 E |
| 1,379,724 | 1/1975 | United Kingdom | 273/73 E |

*Primary Examiner*—Richard J. Apley

[57] ABSTRACT

A tension device on a tennis racquet which when activated can adjust the tension of the strung area after the tennis racquet has been completely strung. This new invention consists of movable sidewalls attached to the fixed frame of a tennis racquet, to which the strings are attached. Thus when the movable sidewall with strings attached is activated the tension of the strung area is adjusted.

1 Claim, 2 Drawing Figures

ADJUSTABLE TENNIS RACQUET

BACKGROUND OF THE INVENTION

The present method of stringing a tennis racquet produces a fixed tension in the strung area. The tension in the said strung area can not be adjusted once the racquet is strung. There are numerous factors that can alter the initial tension which was intended to be placed on the strung area. It is change of tension of the strung area which impairs the efficiency of the tennis racquet.

The improper tension of the strung area in a tennis racquet can be a result of any of the following means: improper tension at the time of initial stringing, continued use of the racquet causing the strung area to stretch, atmospheric conditions which result in contraction or expansion of the frame of the tennis racquet.

So far as is known this new and simple arrangement consisting of one or more adjustable sides in the frame of a tennis racquet to adjust the tension of the strung area of a strung racquet as described and claimed herein has not been known heretofore.

SUMMARY OF THE INVENTION

This invention relates to a mechanism which when affixed to a tennis racquet regulates the tension of the strung area of the tennis racquet after the racquet has been strung. Still more particularly this invention employs a new and not previously known method of achieving the desired tension on the strung area of a previously strung tennis racquet. Since this method of adjusting the strung area of a strung tennis racquet has not been known before, this invention initiates and incorporates the concept of design of using a movable sidewall to which the strings of the racquet are threaded through to achieve the tension desired.

THE PREFERRED EMBODIMENT

Figure 1:
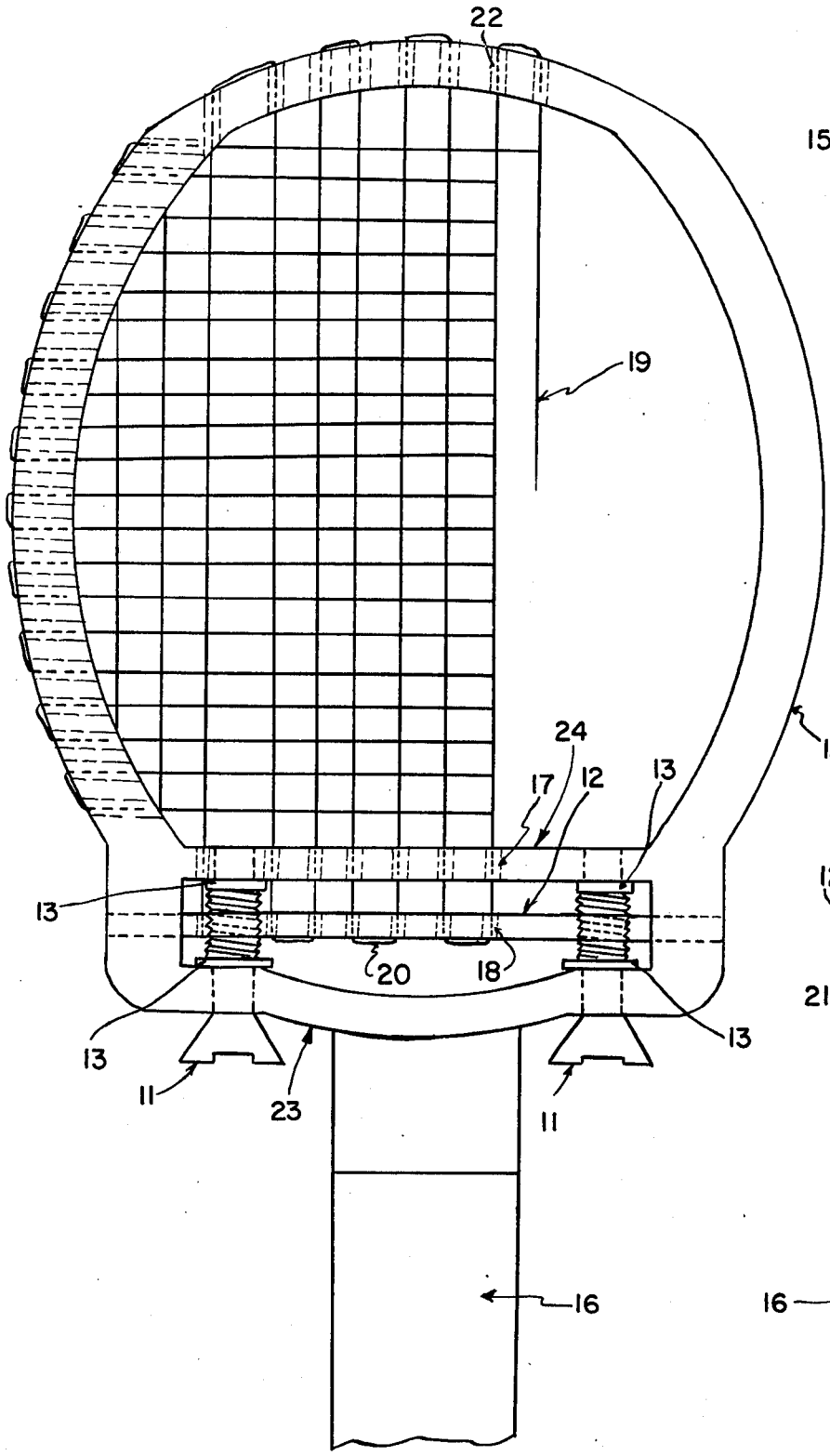
FIG. 1 is an overall front view of the invention with the tensioning mechanism placed in the lower horizontal section of the tennis racquet frame.

The invention can be understood by turning first to FIG. 1 wherein it shows the complete frame 15 with the adjustable tensioning bar 12 in position and engaged by two wing bolts 11. The wing bolts 11 pass through the lower fixed frame section 23 at the throat portion of the frame, then through the adjustable tensioning bar 12, even through the upper fixed frame section 24. The area in which the wing bolt 11 passes through the adjustable tension bar 12 is the screw threaded section of wing bolt 11. The screw thread on the wing bolt 11 is indicated in both FIG. 1 and FIG. 2 between the upper and lower retaining nuts 13. It is also to be noted that the adjustable tension bar 12 is threaded in the opening where the screw thread of the wing bolt 11 passes through. The retaining nuts 13 maintain the position of wing bolt 11 between the lower fixed frame section 23 and upper fixed frame section 24. It is to be noted that the areas of the wing bolt 11 that pivot in the lower fixed frame section 23 and upper fixed frame section 24 are not threaded and rotate freely in the frame.

Figure 2:
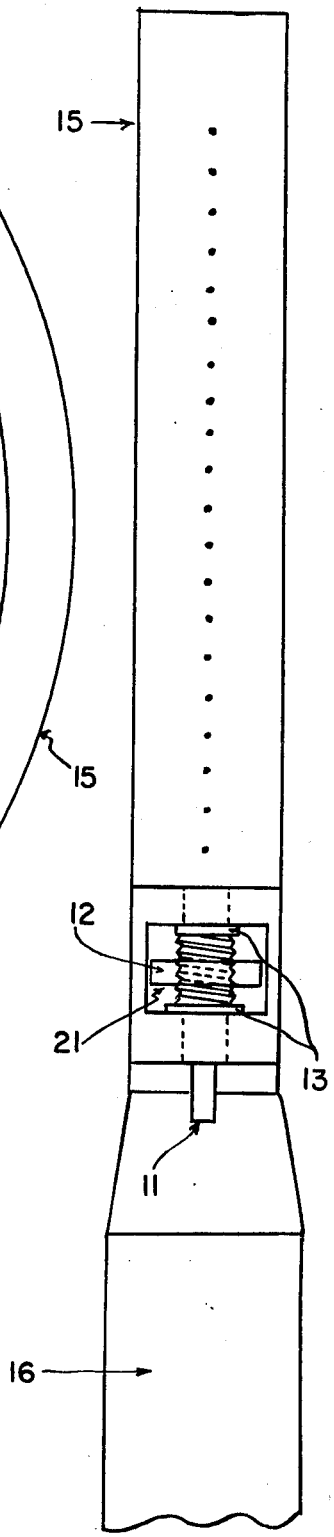
FIG. 2 is an overall side view of the invention with the tensioning mechanism placed in the lower horizontal section of the tennis racquet frame.

In FIG. 2 the wing bolt 11 is shown passing through the adjustable tension bar 12. Also shown in FIG. 2 is the area 21 which permits vertical travel of the adjustable tension bar 12 within the frame 15, but which confines horizontal movement by the size of the area. As discernible from both FIG. 1 and FIG. 2, the turning of wing bolt 11 will move the adjustable tension bar 12 up or down on the screw threaded area of wing bolt 11.

In FIG. 1 the string material 19 is shown passing through string hole 22 at the top of the frame, then down through string hole 17 and then down through string hole 18 in adjustable tension bar 12. The stringing material 19 then passes through the next adjacent thread hole in the adjustable tension bar 12 and travels upward through the string holes. The continuous threading of the string material 19 through the adjustable tension bar 12 is indicated as shown at point 20. The handle 16 of the tennis racquet is shown joining the frame 15.

As stated in the abstract of the disclosure, it is a particular objective of this invention to provide a method of adjusting the strung area of a previously strung tennis racquet. The feature and advantage of this invention is an adjustable tension bar which is activated by turning the wing bolts. Thusly, the strung material which had previously been threaded through the adjustable tension bar and fixed frame can be tightened or loosened by raising or lowering the tension bar.

I claim:

1. A tennis racket with means for adjusting string tension comprising: a racket frame having a head portion carrying longitudinal and horizontal strings, a throat portion and a handle portion, a pair of spaced apart horizontal frame members located at the throat portion and fixedly attached to opposed sides of the frame, the frame sides and the pair of frame members forming an enclosed space, the tension adjusting means including a longitudinally moveable, horizontally extending tension bar located between the pair of frame members and within the enclosed space so that its horizontal movement in a plane perpendicular to the racket plane is restricted, the racket being strung so that the longitudinal strings extend freely through the upper frame member and then attached to the tension bar, a pair of screws threadedly engaging and extending through the tension bar and held in position by the pair of frame members, the screws having their manipulable ends extending outwardly from the lower frame member so that upon turning of the screws the tension bar is longitudinally displaced thereby adjusting the tension of the strings.

* * * * *